US007396250B1

(12) United States Patent
Huang

(10) Patent No.: US 7,396,250 B1
(45) Date of Patent: Jul. 8, 2008

(54) PLUGGING DEVICE FOR NETWORK CABLE

(76) Inventor: Kui-Hsien Huang, 10F-1, No. 452, Sec. 5, Cheng Kung Rd., Neiha District, Taipei City (TW)

( * ) Notice: Subject to any disclaimer, the term of this patent is extended or adjusted under 35 U.S.C. 154(b) by 0 days.

(21) Appl. No.: 11/777,289

(22) Filed: Jul. 13, 2007

(51) Int. Cl.
*H01R 13/62* (2006.01)

(52) U.S. Cl. ..... 439/352; 439/351; 439/353; 439/361; 439/372

(58) Field of Classification Search ..... 439/351–353, 439/361, 372, 344, 345
See application file for complete search history.

(56) References Cited

U.S. PATENT DOCUMENTS

| | | | | |
|---|---|---|---|---|
| 2,775,744 | A * | 12/1956 | Henneman | 439/269.2 |
| 3,159,445 | A * | 12/1964 | Wolk | 439/269.2 |
| 4,711,511 | A * | 12/1987 | Noorily | 439/347 |
| 4,828,510 | A * | 5/1989 | Muzslay | 439/352 |
| 5,004,431 | A * | 4/1991 | Previato et al. | 439/358 |
| 5,411,402 | A * | 5/1995 | Bethurum | 439/77 |
| 6,179,643 | B1 * | 1/2001 | Fukuda | 439/358 |
| 6,319,042 | B2 * | 11/2001 | Hirschmann | 439/352 |
| 6,488,524 | B2 * | 12/2002 | Endo | 439/353 |
| 6,572,275 | B2 * | 6/2003 | Shimoji et al. | 385/76 |
| 6,790,070 | B1 * | 9/2004 | England, II | 439/372 |
| 6,918,782 | B2 * | 7/2005 | Foster | 439/352 |
| 6,994,580 | B1 * | 2/2006 | Chen | 439/344 |
| 7,014,491 | B1 * | 3/2006 | Simmel | 439/353 |
| 7,025,618 | B2 * | 4/2006 | Fukuda | 439/353 |
| 7,037,129 | B2 * | 5/2006 | Lo et al. | 439/352 |
| 7,114,981 | B1 * | 10/2006 | Huang et al. | 439/353 |
| 7,163,414 | B2 * | 1/2007 | Lo et al. | 439/352 |
| 7,229,305 | B2 * | 6/2007 | Hirschmann | 439/352 |
| 2006/0211291 | A1 * | 9/2006 | Kung | 439/352 |
| 2006/0223355 | A1 * | 10/2006 | Hirschmann | 439/352 |
| 2007/0243747 | A1 * | 10/2007 | Kinskey et al. | 439/352 |

* cited by examiner

*Primary Examiner*—Briggitte R. Hammond
*Assistant Examiner*—Larisa Z Tsukerman
(74) *Attorney, Agent, or Firm*—Leong C. Lei

(57) ABSTRACT

The plugging device of the present invention provides a pair of sticks similar to the blades of a scissor on top of the connector of the plugging device. The pair of sticks is closed together when they are plugged into a network socket along with the connector. Then, by twisting a knob of the plugging device behind the connector, the two sticks are opened so that the hooks at the front ends of the sticks lock to the network socket for reliable connection. To unplug, the knob is twisted in a reversed direction and the two sticks are closed together again so that they are free to be pulled out of the network socket along with the connector.

3 Claims, 6 Drawing Sheets

PLUGGING DEVICE FOR NETWORK CABLE

TECHNICAL FIELD OF THE INVENTION

The present invention generally relates to network cabling, and more particularly to a plugging device installed at an end of a network cable for reliably plugging the network cable into a network socket.

DESCRIPTION OF THE PRIOR ART

The reliable connection of a network cable to a network socket (on the wall or on a device) is vital to the integrity of network communications. HG 7 shows a conventional plugging device A10 commonly seen in local area networking that is installed at an end of a network cable A3.

The conventional plugging device A10 mainly relies on a resilient plastic piece A1 on top of a plastic connector A2 to lock to the network socket (not shown). This design has been around in the networking industry for decades and is notorious for the following disadvantages.

First of all, the plastic piece A1 is rather fragile and often damaged during manufacture, transportation, usage, etc. Once the piece A1 is deformed or broken, the plugging device A10 can no longer provide reliable network connection and the entire plugging device A10 or even the entire cable A3 has to be replaced, which is quite wasteful.

Secondly, the elasticity of the piece A1 would invariably deteriorate after constant plugging and unplugging. Again, when the piece A1 can no longer securely lock to the network socket, the plugging device A10 fails to provide reliable network connection.

Usually only a small section of the piece A1 is left exposed outside the network socket when it is plugged into the network socket. It is therefore difficult to access and press the piece A1 to release the plugging device A10. As a result, it is not uncommon that a user hurts his or her fingernail trying to unplug a network cable.

SUMMARY OF THE INVENTION

The primary purpose of the present invention is to provide an innovative solution.

The plugging device of the present invention provides a pair of sticks similar to the blades of a scissor on top of the connector of the plugging device. The pair of sticks is closed together when they are plugged into a network socket along with the connector. Then, by twisting a knob of the plugging device behind the connector, the two sticks are opened so that the hooks at the front ends of the sticks lock to the network socket for reliable connection. To unplug, the knob is twisted in a reversed direction and the two sticks are closed together again so that they are free to be pulled out of the network socket along with the connector.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
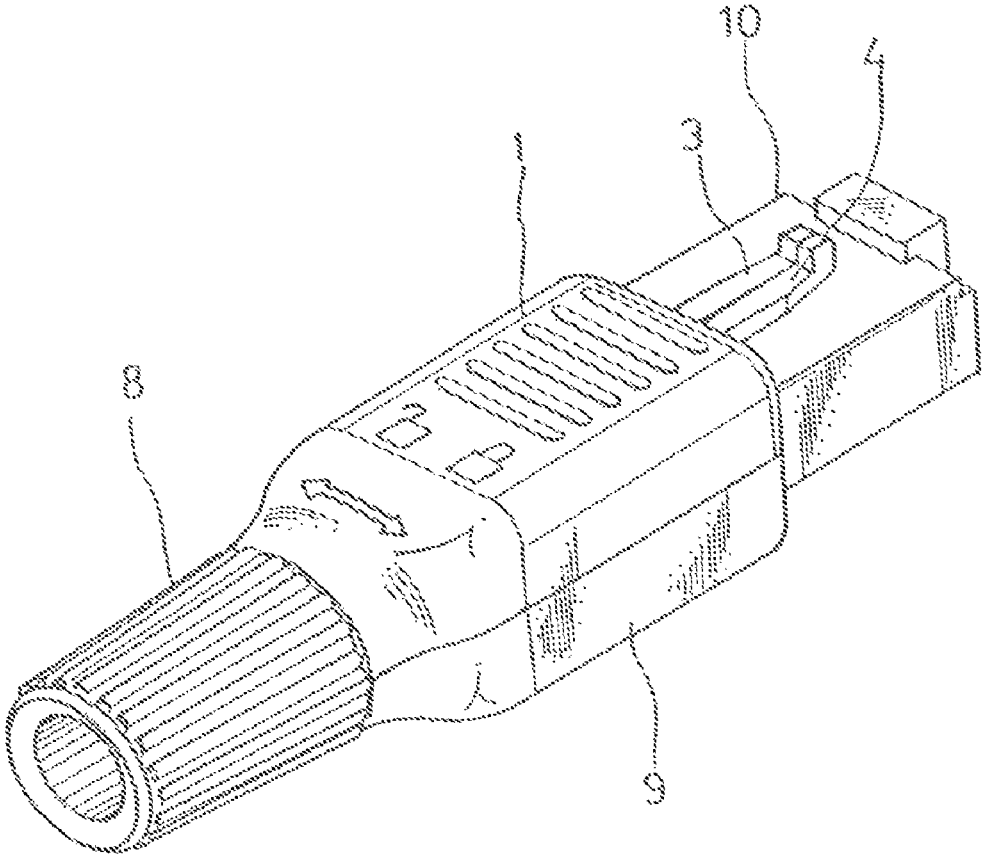
FIG. 1 is a perspective view showing a plugging device according to an embodiment of the present invention.
Figure 2:
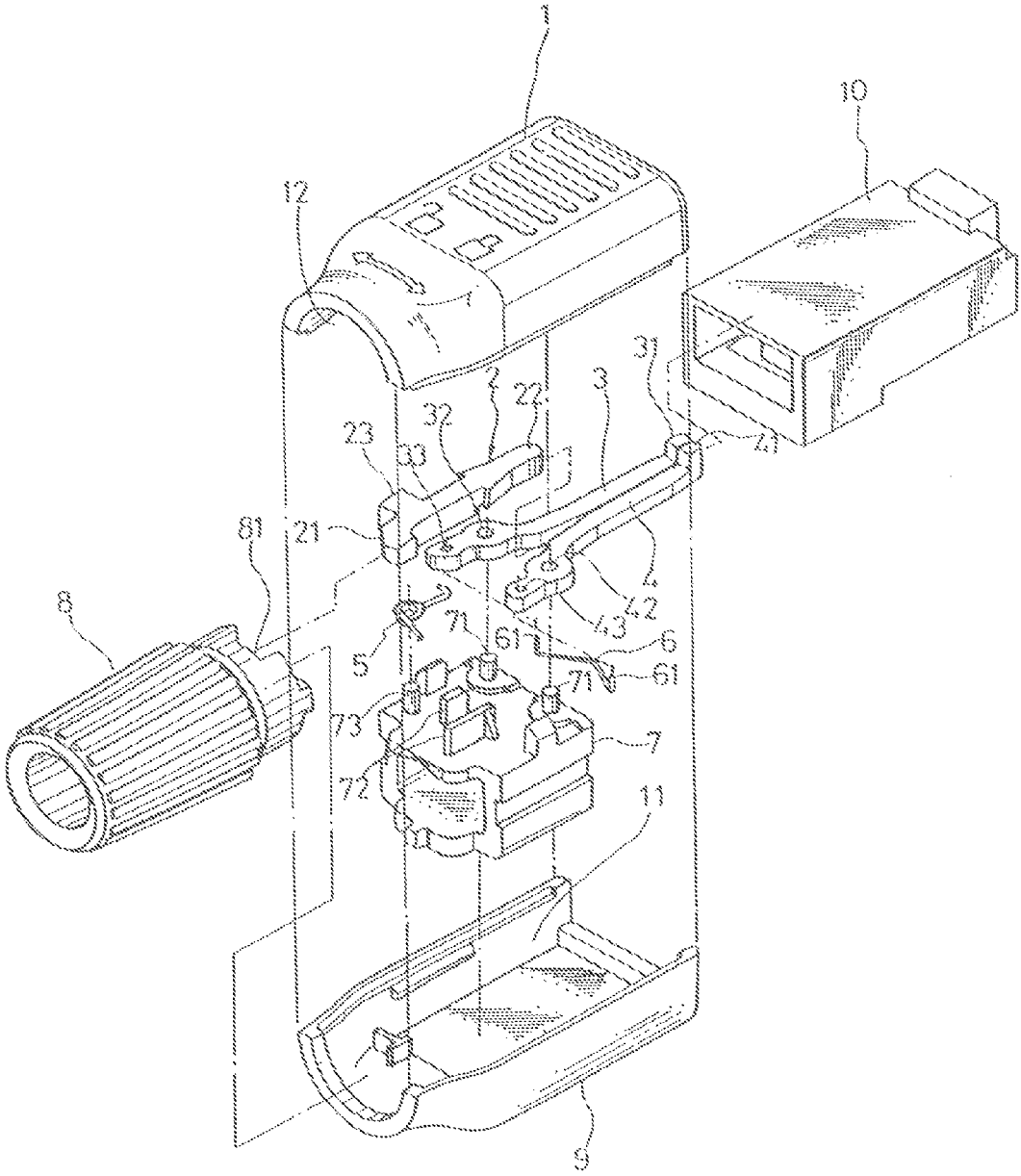
FIG. 2 is a perspective exploded view showing the various components of the plugging device of FIG. 1.

As shown in FIGS. 1 and 2, a network cable plugging device according to an embodiment of the present invention installed at an end of a network cable (not shown) has a top cover 1 and a bottom cover 9 vertically joined together into a hollow casing having an internal space 11 for housing the other components of the plugging device. A circular opening 12 is formed at a back end of the casing for the accommodation of the network cable and a twisting knob 8 around the network cable. A rectangular opening (not numbered) is also formed at a front end of the casing for the accommodation of a connector 10. The connector 10 has the electrical and mechanical characteristics conforming to a specific standard so that it can be plugged into a compatible conventional network socket. The wires inside the network cable have leads on the connector 10 but for simplicity they are not shown in the drawings. As illustrated in FIG. 1, the connector 10 is extended from the internal space 11 towards the front for an appropriate distance beyond the front opening. In addition, a left stick 3 and a right stick 4 above the connector 10 are also extended from the internal space 11 of the plugging device towards the front for an appropriate distance between the front opening and the front edge of the connector 10.

As shown in FIG. 2, the left and right sticks 3 and 4 have symmetrical shapes and are arranged laterally so that their front sections are side-by-side together but the back sections are apart. The left and right sticks 3 and 4 have hooks 31 and 41 at their front ends, and pin holes 32 and 42 at their back sections, respectively. The left and right sticks 3 and 4 therefore have their pin holes 32 and 42 pin-joined to two pins 71 on a top side of a base member 7, respectively. The left and right sticks 3 and 4 further have through holes 33 and 43 at their back ends, respectively, so that a resilient element 6 (e.g., a wire-form spring) has its two ends 61 connected to the through holes 33 and 43, respectively. As configured as such, the left and right sticks 3 and 4 can have their front ends (i.e., the hooks 31 and 41) pivotally opened and closed, similar to the blades of a scissor. Due to the resilient element 6, the left and right sticks 3 and 4 have a tendency to have their front sections closed together. Once a force causing the front sections to expand (i.e., to compress the resilient element 6) is removed, the resilient element 6 expands to close the front sections together automatically.

Figure 3:
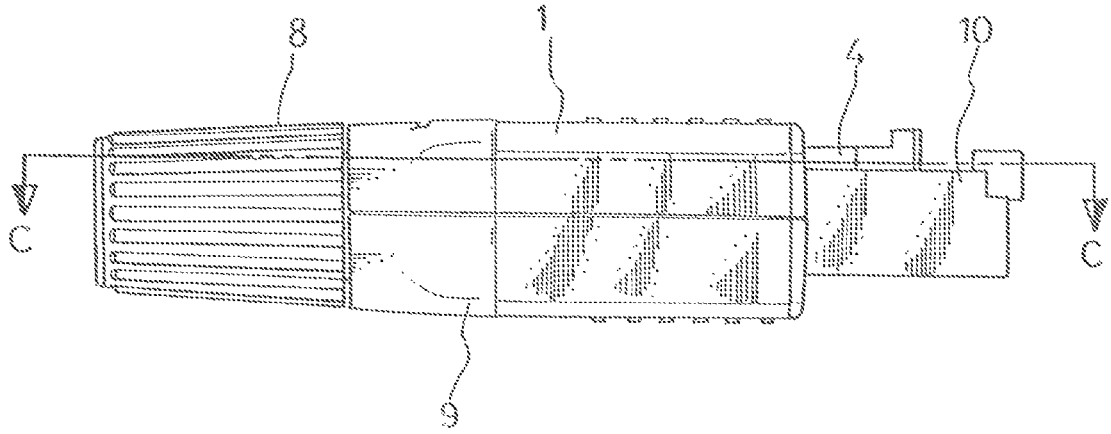
FIG. 3 is a profile view showing the plugging device of FIG. 1.
Figure 4:
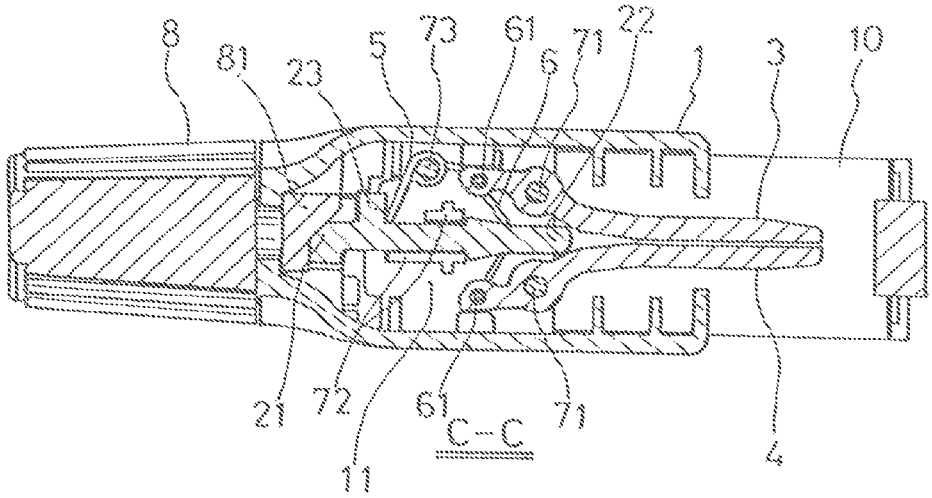
FIG. 4 is a cross-sectional view of the plugging device along the C-C cross-section of HG 3.

Also on the top side of the base member 7, a driving stick 2 is positioned between the back sections of and parallel to the front sections of the left and right sticks 3 and 4. Please also refer to FIGS. 3 and 4. The driving stick 2 has a front tip 22 directly against where the back sections of the left and right sticks 3 and 4 are spread apart, a middle section bounded by two guiding plates 72 of the base member 7 so that the driving stick 2 can only move forward towards or backward away from the left and right sticks 3 and 4, and a protrusion 23 to a side of the driving stick 2 for connection to another resilient element (e.g., a torsion spring) 5. The resilient element 5 is besides the driving stick 2 and is threaded by a pin 73 on the top side of the base member 7. The resilient element 5 has an end connected to the protrusion 23 and, as such, the driving stick 2 has a tendency not to press against the left and right sticks 3 and 4. Once a force causing the driving stick 2 to move forward and push the left and right sticks 3 and 4 (i.e., to compress the resilient element 5) is removed, the resilient element 5 expands to pull the driving stick 2 backward automatically.

Figure 5:
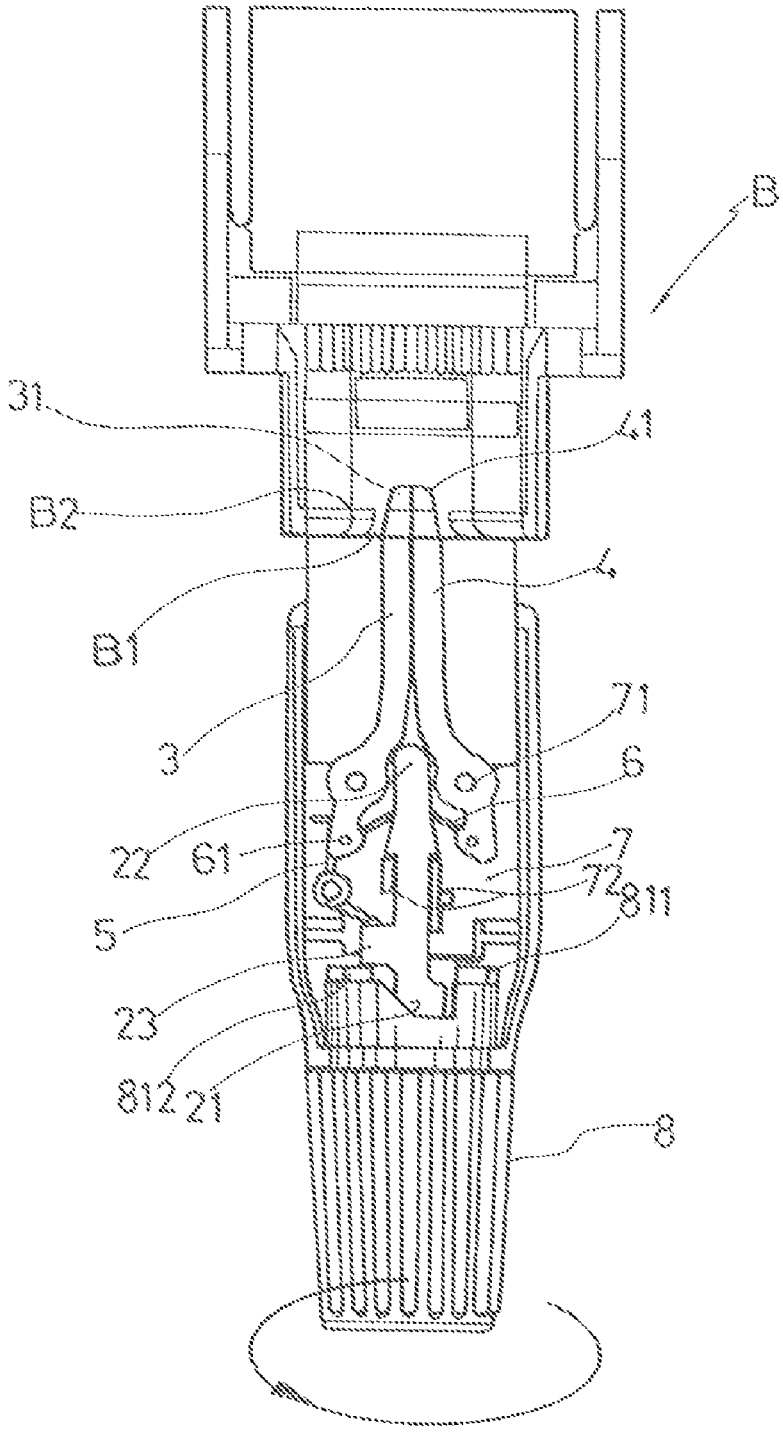
FIG. 5 is a top view showing the inside of the plugging device of FIG. 1 as it is plugged into a network socket and the knob is to be twisted clockwise.
Figure 6:
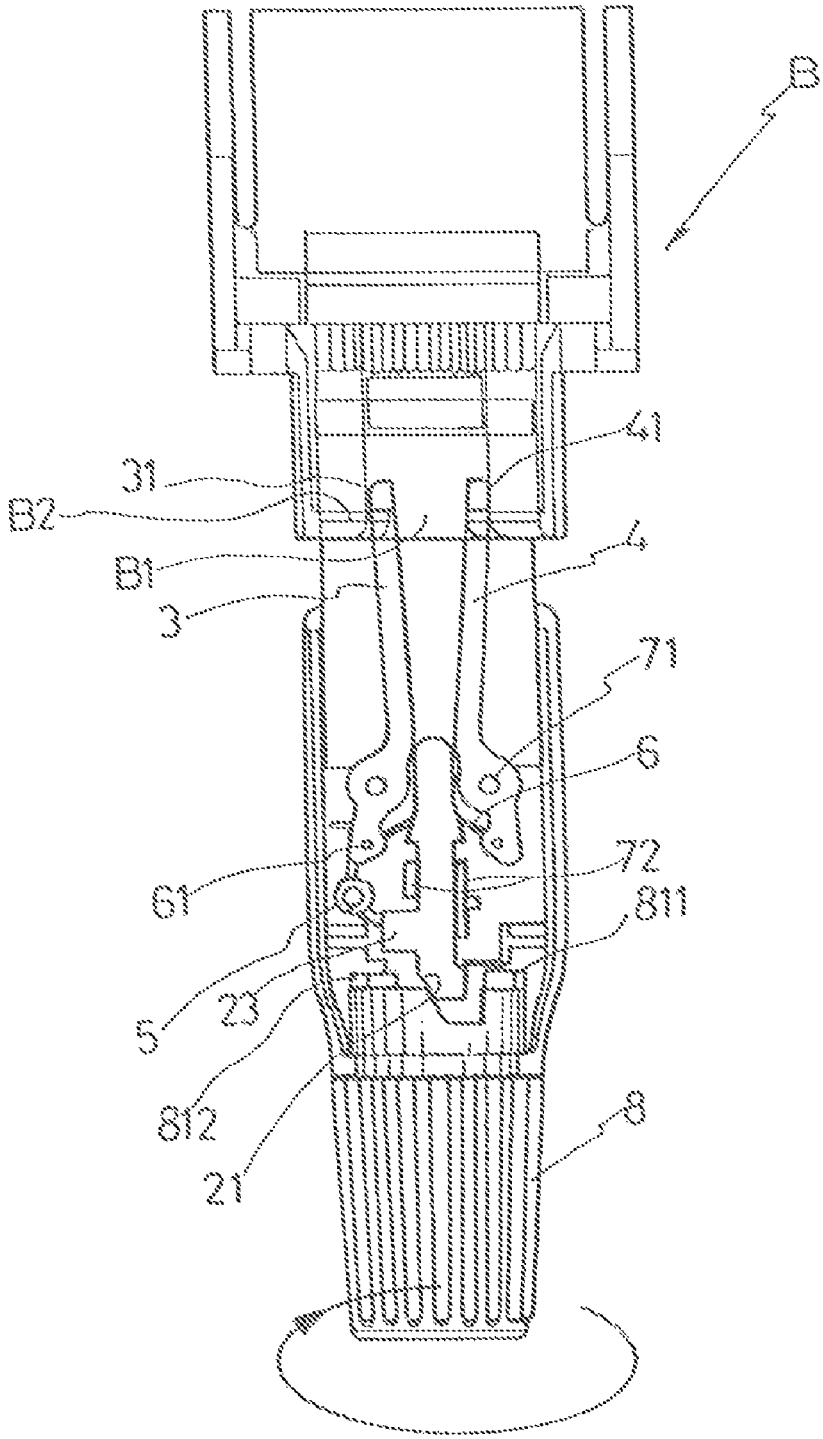
FIG. 6 is a top view showing the inside of the plugging device of FIG. 1 as it is locked to a network socket and the knob is to be twisted counterclockwise.
Figure 7:
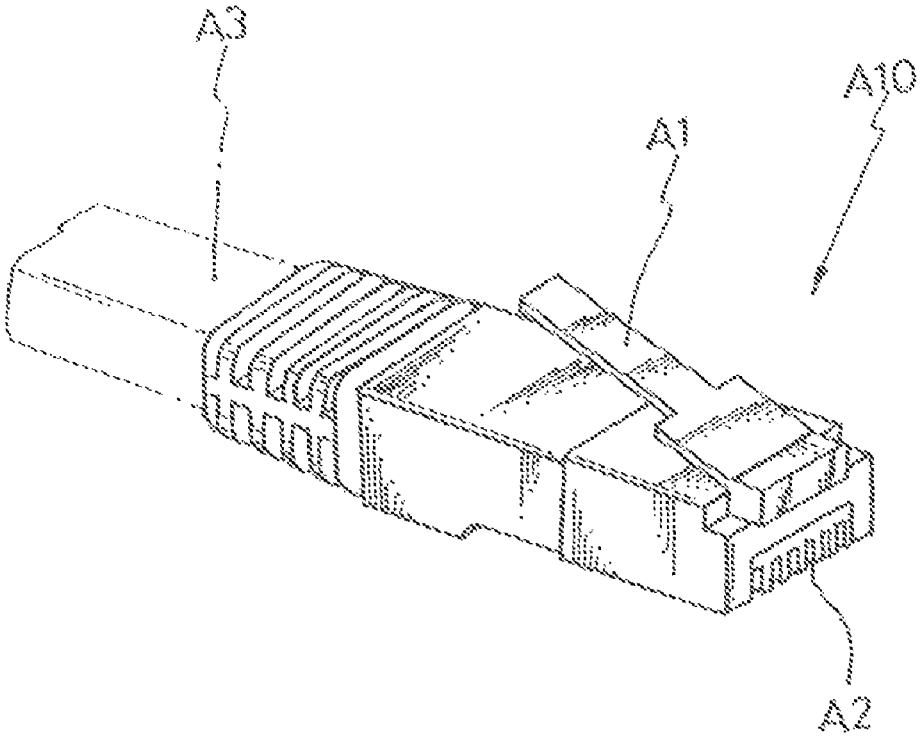
PRIOR ART FIG. 7
FIG. 7 is a perspective view showing a conventional plugging device.

As shown in FIGS. 5 and 6, a back end 21 of the driving stick 2 interacts with a notch 81 at a front end of the knob 8. The notch 81 has the shape of a trapezoid with an opening (i.e., a longer base of the trapezoid) and a slant lateral side (both not numbered). Correspondingly, the back end 21 of the driving stick 2 is also slanted and interfaced with the slant lateral side of the notch 81 so that, in the present embodiment, when the knob 8 is twisted clockwise, the slant lateral side of the notch 81 advances the slant back end 21 (and, therefore, the driving stick 2 itself) forward; and when the knob is twisted counterclockwise, the driving stick 2 are withdrawn by the resilient element 5 while the slant back end 21 slides down the slant lateral side into the notch 81. To prevent the back end 21 of the driving stick 2 from escaping from the notch 81, two stopping blocks 811 and 812 are positioned at the two sides of the opening of the notch 81, respectively.

As shown in FIGS. 5 and 6, a conventional network socket B has a rectangular opening B1 to receive the connector 10 of the plugging device. Two stopping blocks B2 are positioned along the top edge of the opening B1, leaving a gap (not numbered) therebetween. To plug the plugging device of the present embodiment into the network socket B, the plugging device with the front sections of the left and right hooks 3 and 4 closed together is inserted into the opening B1 of the network socket B, as shown in FIG. 5. Please note that the hooks 31 and 41 at the front ends of the left and right sticks 3 and 4 are able to enter the network socket B via the gap of the opening B1. Them, by twisting the knob 8 clockwise, the slant lateral side of the notch 81 advances the slant back end 21 (and, therefore, the driving stick 2) forward. The front tip 22 of the driving stick 2 therefore squeezes between and forces open the front sections of the left and right sticks 3 and 4, as shown in HG 6. The hooks 31 and 41 are thereby positioned in front of and blocked by the stopping blocks B2, respectively, and the plugging device therefore cannot be pulled backward out of the network socket B. To unplug the plugging device from the network socket B, the knob 8 is twisted counterclockwise as shown in HG 6. The driving stick 2 is withdrawn by the resilient element 5 while the slant back end 21 slides down the slant lateral side into the notch 81. In the mean time, as the driving stick 2 is pulled away from the left and right sticks 3 and 4, the resilient element 6 automatically closes the front sections of the left and right sticks 3 and 4 together so that their front tips 31 and 41 are free to exit from the gap of the opening B1 of the network socket B.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A plugging device at an end of a network cable, comprising:

a top cover and a bottom cover vertically joined together to form a casing having an internal space, a circular opening at a back end, and a rectangular opening at a front end;

a connector occupying said front opening and extending from said internal space and beyond said front opening for an appropriate distance;

a knob around said end of said network cable occupying said back opening and having a front section inside said internal space and a back section behind said back opening, said knob capable of being twisted clockwise and counterclockwise, said knob having a notch at a front end with a front opening and a slant lateral side;

a base member inside said internal space between said connector and said knob having two pins on a top side;

a left stick and a right stick inside said internal space and on top of said base member extended from said internal space for an appropriate distance between said front opening and the front edge of said connector, said left and right sticks having symmetrical shapes and arranged laterally so that front sections of said left and right sticks are close together and back sections of said left and right sticks are apart, said left and right sticks having hooks at front ends, pin holes at said back sections, and through holes at back ends, respectively, said left and right sticks pin-joined to said base member by having said pins of said base member inside said pin holes, respectively, so that said left and right sticks are capable of having said front sections opened apart and closed together;

a first resilient element inside said internal space and on top of said base member whose two ends are connected to said through holes of said left and right sticks, respectively, wherein said first resilient element is compressed when said front sections of said left and right sticks are opened and said back sections of said left and right sticks are closed together;

a driving stick inside said internal space and on top of said base member between said back sections of said left and right sticks, said driving stick having a front tip directly against where said back sections of said left and right sticks are spread apart and a slant back end interfacing with said slant lateral side of said notch of said knob; and a second resilient element inside said internal space on top of said base member besides said driving stick, an end of said second resilient element connected to a side of said driving stick so that said second resilient element is compressed when said driving stick moves forward;

wherein, when said knob is twisted in a first direction, said driving stick is advanced forward to compress said second resilient element and to force said front sections of said left and right sticks to open, thereby compressing said first resilient element, as said slant lateral side of said notch pushes said slant back end of said driving stick; and, when said knob is twisted in a second direction opposite to said first direction, said driving stick retreats by the resilience of said second resilient element as said slant back end of said driving stick slides into said notch along said slant lateral side of said notch while the resilience of said first resilient element closes said front sections of said left and right sticks together.

2. The plugging device according to claim 1, wherein two stopping blocks are at the two sides of said front opening of said notch, respectively.

3. The plugging device according to claim 1, wherein said base member has a pair of guiding plates at the two sides of a middle section of said driving stick so that said driving stick are confined to move only forward and backward.

* * * * *